United States Patent [19]

Dekker et al.

[11] Patent Number: 4,887,808

[45] Date of Patent: Dec. 19, 1989

[54] COMPACT BILL ACCEPTOR

[75] Inventors: Donald A. Dekker, Grand Rapids; Lawrence Zandstra, Rockford, both of Mich.

[73] Assignee: Rowe International, Inc., Whippany, N.J.

[21] Appl. No.: 209,418

[22] Filed: Jun. 20, 1988

[51] Int. Cl.[4] ..... B65H 29/46

[52] U.S. Cl. ..... 271/181; 271/218

[58] Field of Search ..... 271/312, 313, 177, 180, 271/181, 198, 213–215, 207, 218, 219; 74/49; 194/350; 109/64, 67; 220/18, 334; 312/107

[56] References Cited

U.S. PATENT DOCUMENTS 3,917,260 11/1975 Okkonen ..... 271/181
4,678,072 7/1987 Kobayashi et al. ..... 271/181
4,722,519 2/1988 Zouzoulas ..... 271/181
4,765,607 8/1988 Zouzoulas ..... 271/181

FOREIGN PATENT DOCUMENTS 86-05301 9/1986 World Int. Prop. O. ..... 271/181

*Primary Examiner*—H. Grant Skaggs
*Attorney, Agent, or Firm*—Shenier & O'Connor

[57] ABSTRACT

An improved compact bill acceptor having a frame provided with transport means for carrying a bill inserted therein along a path from an inlet to the space between a ram and the front opening of a bill box carried by the frame and a compound slide connected between the frame and the ram for reciprocating the ram to drive a positioned bill into the bill box. Preferably the bill box has open sides closed by side panels pivotally mounted on the frame to permit the box to be unloaded through one of the sides.

11 Claims, 3 Drawing Sheets

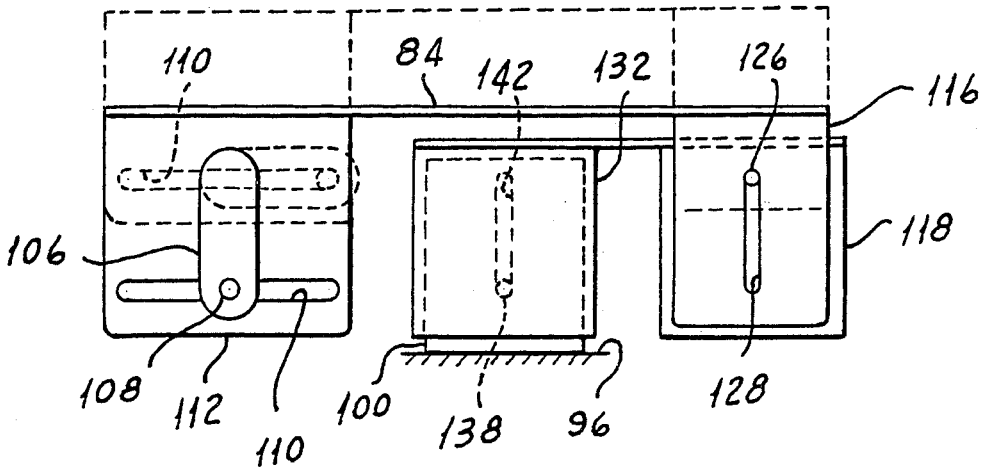
Fig 5
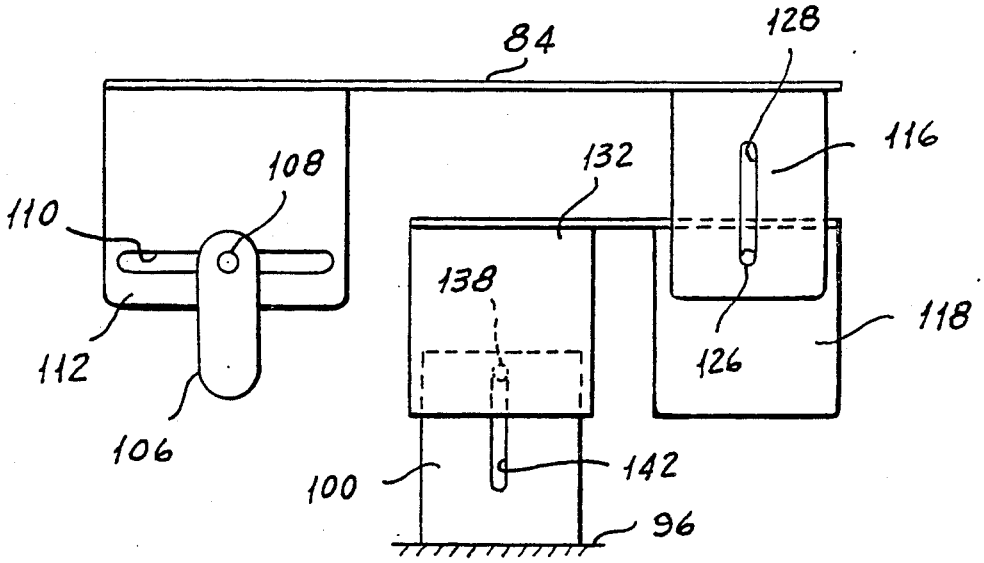

COMPACT BILL ACCEPTOR

FIELD OF THE INVENTION

The invention relates to bill acceptors and, more particularly, to an improved compact bill acceptor which is more versatile than compact bill acceptors of the prior art.

BACKGROUND OF THE INVENTION

There are known in the prior art bill acceptors which are adapted to receive paper currency to test the same for genuineness to put out an electrical signal indicating that a genuine bill has been received and, for example, to dispense change. One such acceptor is shown and described in U.S. Pat. No. 4,470,496, issued on Sept. 11, 1984. Systems of the type described are provided with some means for stacking bills which are accepted. One such bill stacking mechanism is shown and described in U.S. Pat. No. 3,917,260 issued Nov. 4, 1975.

While bill accepting systems of the type described hereinabove effectively achieve their intended purpose of testing bills for genuineness and of stacking acceptable bills in locations at which space is not a consideration, they are relatively bulky and cumbersome for the result achieved thereby. Attempts have been made to provide bill accepting and stacking mechanisms which are more compact than are those described hereinabove by a modified combination of the '496 acceptor with the '260 stacker. The bill stacker shown in the '260 patent includes as a part thereof a ram which drives a bill delivered to the space between the ram and the bill storage area into the storage area. In combining the acceptor of the '496 patent with the stacker of the '260 patent to form a compact bill acceptor, there was employed a ram guide mechanism positioned outwardly of the sides of the bill storage area. It was thus not possible to unload the acceptor from a side so that the possible locations for installation were limited. For example, bill acceptors are now incorporated in many merchandising machines owing to the greater cost of individual items being sold as well as the wide variety of articles dispensed by such machines. The space available at the position in such machines at which a bill acceptor must be installed is at a premium.

SUMMARY OF THE INVENTION

One object of our invention is to provide a compact bill acceptor for accepting genuine bills and storing the same which is more compact than are bill acceptors of the prior art.

Another object of our invention is to provide a compact bill acceptor which is an improvement over compact bill acceptors of the prior art.

A further object of our invention is to provide a compact bill acceptor which is especially adapted for installation in a merchandising machine.

Another object of our invention is to provide a compact bill acceptor which overcomes the defects of compact bill acceptors of the prior art.

Yet another object of our invention is to provide a compact bill acceptor having a bill box which may be unloaded from either side as well as from the top thereof.

Other and further objects of our invention will appear from the following description.

BRIEF DESCRIPTION OF THE DRAWINGS

In the accompanying drawings to which reference is made in the instant specification and which are to be read in conjunction therewith and in which like reference numerals are used to indicate like parts in the various views:

FIG. 4 is a diagrammatic view illustrating the relative positions of the parts of the ram driving mechanism at one point in the course of operation of the bill acceptor.

FIG. 5 is a diagrammatic view illustrating the relative positions of the parts of the ram driving mechanism at another point in the cycle of operation of the bill acceptor.

DESCRIPTION OF THE PREFERRED EMBODIMENT

Figure 1:
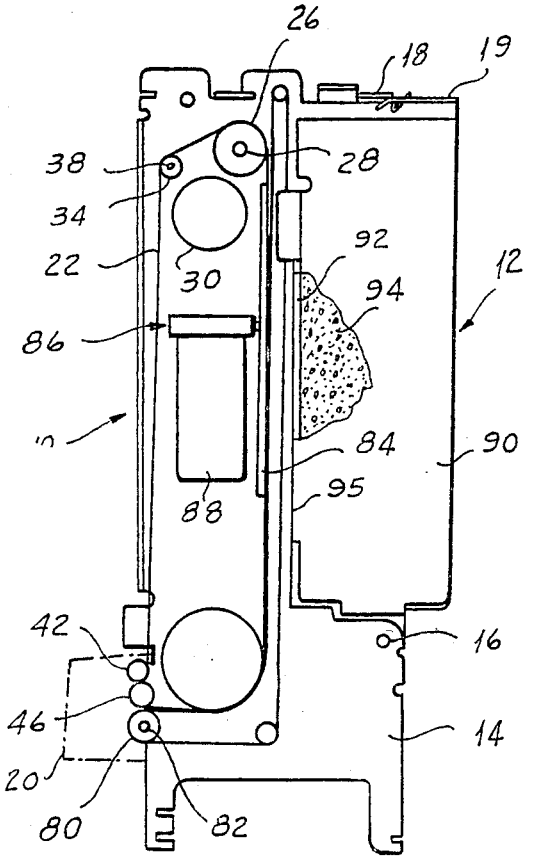
FIG. 1 is a side elevation of one form of our improved compact bill acceptor with parts removed.
Figure 2:
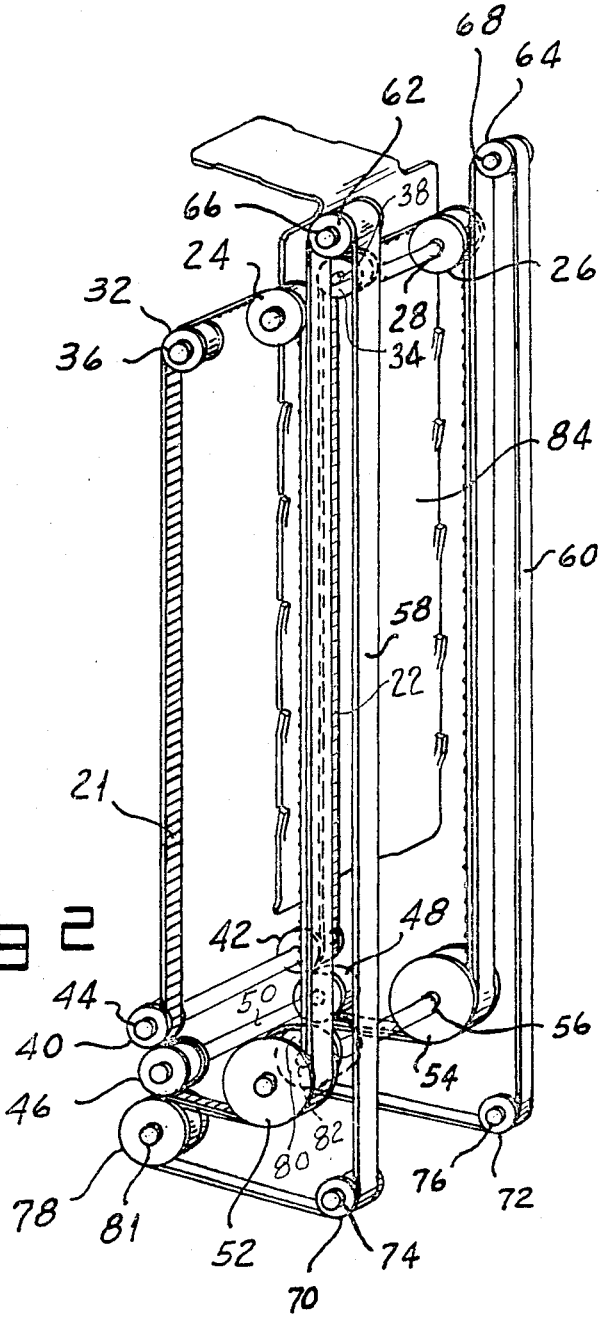
FIG. 2 is a perspective of the bill transport mechanism of the form of our compact bill acceptor illustrated in FIG. 1.
Figure 3:
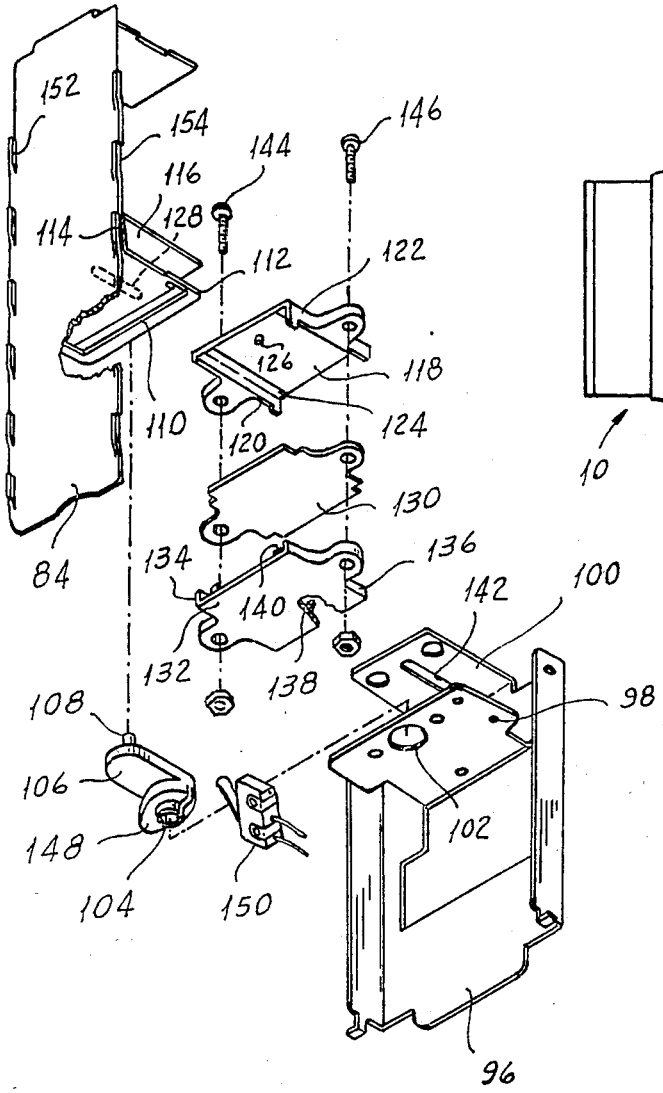
FIG. 3 is an exploded view of the ram driving assembly of the form of our compact bill acceptor illustrated in FIG. 1.

Referring now to FIGS. 1 to 3 of the drawings, our improved compact bill acceptor indicated generally by the reference character 10 has a bill storage box indicated generally by the reference character 12, in which accepted bills are adapted to be stacked in a manner to be described hereinbelow. A frame plate 14 receives a pivot shaft 16 which supports the box 12 for pivotal movement between an operative position at which it is adapted to receive bills and an unloading position at which it is swung away from the acceptor proper so that bills can be removed through the top thereof.

A latch 18 cooperating with a strike 19 normally holds the box 12 in its operative position.

The bill transport of our compact bill acceptor is adapted to receive bills inserted therein through a mouth-forming member 20 illustrated in phantom in FIG. 1, and to carry the bills along a first generally horizontal path portion and then upwardly along a vertical path portion to a position at which they can be moved into the bill box 12 in a manner to be described hereinbelow.

More particularly, the bill transport mechanism includes a pair of spaced timing belts 21 and 22 driven by respective upper drive pulleys 24 and 26 carried by a shaft 28 supported on the acceptor frame. A motor 30 drives the shaft 28 through gearing (not shown). Since the details of the driving mechanism do not per se form a part of our invention, they will not be described in detail.

From the drive pulleys 24 and 26, the belts 20 and 21 extend around tensioning rollers 32 and 34 carried by stub shafts 36 and 38 supported in the acceptor frame. From the tensioning rollers 32 and 34, the belts 21 and 22 extend downwardly past belt retainer pulleys 40 and 42 carried by a shaft 44 supported on the acceptor frame.

After leaving the retainer pulleys 40 and 42, the belts 21 and 22 pass around lower pulleys 46 and 48 carried by a shaft 50 supported in the acceptor frame. From the lower pulleys 46 and 48, the belts 21 and 22 are trained around relatively large diameter guide pulleys 52 and 54 carried by a shaft 56 and back to the drive pulleys 24 and 26.

The transport system also includes a pair of smooth belts 58 and 60 which cooperate with the belts 21 and 22 to carry bills along the bill transport path described hereinabove. The smooth belts 58 and 60 extend downwardly from upper rollers 62 and 64 carried by stub shafts 66 and 68 to lower rear pulleys 70 and 72 carried by stub shafts 74 and 76 on the acceptor frame. The pulleys 70 and 72 direct the belts 58 and 60 around lower front idler pulleys 78 and 80 supported by stub shafts 81 and 82 carried by the frame. After moving around the front pulleys 78 and 80, belts 58 and 60 extend around the guide pulleys 52 and 54 and back up to the rollers 62 and 64.

It will be appreciated that the portions of the belts 58 and 60 extending rearwardly from pulleys 78 and 80 and around guide pulleys 52 and 54 up to the rollers 62 and 64, register with portions of the respective belts 21 and 22 extending rearwardly from lower pulleys 46 and 48 and around pulleys 52 and 54 back to the drive pulleys 24 and 26. These registering portions of the pairs of belts form the bill transport path. In the course of movement along this path, a bill inserted in the acceptor moves along the horizontal path portion and then upwardly along the vertical path portion until it comes to a position in registry with a ram 84 adapted to be driven in a manner to be described to move the bill into the stacker 12. It is to be understood that whatever tests for genuineness are to be performed on a bill are accomplished prior to the time that the bill comes into registry with the ram 84. Since these tests do not per se form part of our invention, they will not be described in detail. As is known in the art, if a bill being tested fails, the drive system reverses so as to return the bill outwardly through the mouth 20.

Our compact bill acceptor includes a drive mechanism indicated generally by the reference character 86 adapted to drive the ram 84 to move a bill in registry therewith into the stacker device 12. When a signal indicating that an acceptable bill has been positioned in front of the ram 84, a motor 88 is energized for one revolution thereof to move the ram through a cycle of its operation.

The stacker mechanism 12 includes a bill storage box 90 having a plate 92 on which a stack of bills is formed by moving the plate into the box 90 against the action of a resilient body 94. Suitable flanges 95 on the mouth of the box 90 prevent the plate 92 from being moved out of the box under the action of the body 94.

Referring now to FIG. 3, the drive mechanism 86 includes a support plate 96 carried by the acceptor frame. We form the plate 96 with a pair of spaced upstanding legs 98 and 100. Plate 98 has an opening 102 adapted to receive a hub 104 secured to the shaft of motor 88 for rotation therewith. Hub 104 carries a crank 106 having a pin 108 adjacent to the end thereof.

We secure the base 114 of a generally U-shaped bracket having legs 112 and 116 to the ram 84. As will be apparent from the description hereinbelow, in the assembled positions of the parts of the drive mechanism 86, a slot 110 in the leg 112 receives the pin 108 on crank 106.

The drive mechanism 86 includes an intermediate subassembly including a top plate 118 having edge flanges 120 and 122 between which the leg 116 is positioned when the assembly is complete. Ribs 124 on the inner surface of the top plate 118 provide a surface along which the leg 116 slides in operation of the device. As the leg 116 is assembled with the plate 118, a boss or pin 126 on the inner surface of the plate 118 is received in a horizontally extending slot 128 in the leg 116.

The intermediate subassembly of the driving mechanism 86 includes a blank divider plate 130 positioned between the upper plate 118 and a lower plate 132 when the parts are assembled. The lower plate 132 has edge flanges 134 and 136 between which the leg 100 is received when the parts are assembled. Ribs 140 on the inner surface of plate 132 provide a sliding surface for the leg 100. When the leg 100 is assembled with the lower plate 132, a boss or pin 138 on the inner surface of plate 132 is disposed in a horizontal slot 142 in the leg 100.

Any suitable means, such as screws 144 and 146, may be employed to hold the upper plate 118, the intermediate plate 130 and the bottom plate 132 in assembled relationship with the leg 116 sandwiched between plates 118 and 130 and with the leg 100 sandwiched between the plates 130 and 132. As has been explained hereinabove, in the assembled positions of the parts, pin 126 is disposed in slot 128 while pin 138 is disposed in the slot 142.

A cam 148 on the hub 104 is adapted to operate a switch 150 to hold the circuit of motor 88 for a full revolution thereof.

Preferably we form the side edges of the ram 84 with a plurality of teeth 152 and 154 spaced along the edges. These teeth are lanced out from the back of the plate forming the ram and the burrs formed in the course of the lancing operation are not removed but left in place. These teeth 152 and 154 serve to prevent lateral movement of a bill being moved into the storage box 90. The teeth are an improvement over rubber strips or the like which are used in the prior art in that the teeth 152 and 154 are relatively less expensive and are not subject to appreciable wear.

Figure 7:
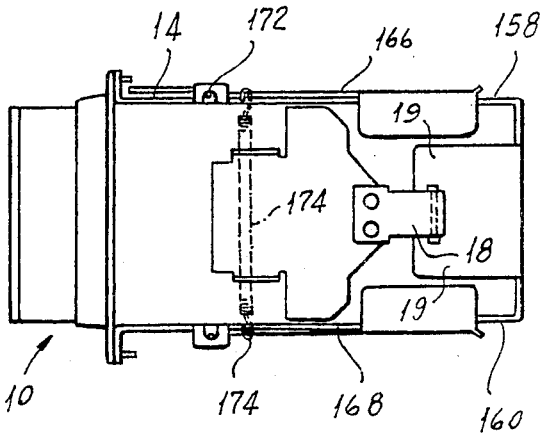
FIG. 7 is a top plan of the form of our compact bill acceptor illustrated in FIG. 6.
Figure 6:
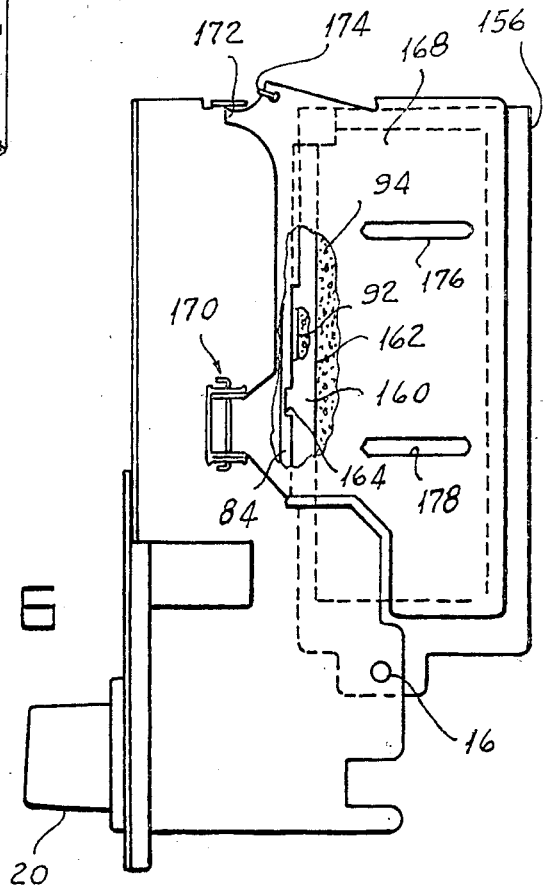
FIG. 6 is a side elevation of our improved compact bill acceptor having a preferred form of bill receiving box.

Referring now to FIGS. 6 and 7, the acceptor including the ram driving mechanism 86 is especially adapted for use with a bill box 156 having sides 158 and 160. As in the embodiment illustrated in FIG. 1, the box 156 normally is held in an operative position at which it can receive genuine bills by means of a latch 18 cooperating with a strike 19 on the box 156. The front edges of the sides 158 and 160 are provided with retaining tabs 164 for preventing plate 92 from moving out of the box 156 under the action of the body 94 of a resilient material.

As in the embodiment illustrated in FIG. 1, the catch 18 can be released to permit the box 156 to swing in a clockwise direction around pivot 16 to permit the removal of bills therefrom.

We form each of the sides 158 and 160 of box 156 with an opening 162 for permitting bills to be withdrawn from the box through the side.

We provide respective side panels 166 and 168 for normally closing the openings 162 in the sides 158 and 160 of the box 156 in the operative position thereof in which it is held by the catch 18. Each of the side panels 166 and 168 is provided with a lower hinge indicated generally by the reference character 170 and with an upper pivot 172 which support the side panel on the acceptor frame for swinging movement toward and away from the associated side 158 or 160 of the box 156.

A tension spring 174, the ends of which are attached to the side panels 166 and 168 at the upper edges thereof, normally urges the side panels to positions at which they overlie the openings 162 in the sides 158 and 160 of the box 156.

The box structure just described in connection with FIGS. 6 and 7 facilitates the use of our compact bill acceptor in locations which could not be accommodated by bill acceptors of the prior art. First, it permits the acceptor to be installed at a location at which the box 156 cannot swing around pivot 16 for unloading owing to a lack of space behind the box. In such an installation, the box can be unloaded by swinging either of the side panels 166 or 168 away from the box, so as to afford access to the interior thereof through one of the openings 162. In addition, the bill acceptor may be installed in a location at which there is neither room behind the acceptor to permit the box 156 to pivot nor room at one side thereof to permit one of the panels 166 and 168 to be rotated to a position at which the interior of the box 156 is accessible through the associated opening 162. All that is required is that there be room at one side of the acceptor to permit one of the panels 166 or 168 to be opened or that there be enough room behind the acceptor for the box 156 to swing about its pivot 16.

In operation of our improved bill acceptor, when a bill is inserted into the mouth 40 motor 30 is energized to drive belts 21 and 22 to carry the bill along the transport path to permit it to be examined in a manner known to the art. If, for any reason, the bill fails the test of genuineness, the transport system is reversed and the bill is returned through the mouth 40. If the bill passes all tests it ultimately comes to a position between the ram 84 and the mouth of the box 90 or 156. At this point in the course of operation of the device, the signal indicating that the bill is acceptable energizes motor 88 to rotate crank 106. Cam 148 cooperates with switch 150 in a manner known to the art to ensure that the motor 88 makes only a single revolution.

The operation of the drive linkage 86 in moving the ram 84 into the box 90 or 156 and returning it to its home position, can best be understood by reference to FIGS. 4 and 5. FIG. 4 illustrates the initial position of the parts in which it can be seen that pin 108 and slot 110 in leg 112 are closest to the plate 96. In this position of the parts, leg 116 which moves with leg 112 is telescoped between plates 118 and 130 with pin 126 disposed at the end of slot 128 closer to ram 184. At the same time, leg 100 is telescoped into the space between plates 130 and 132 with the pin 138 at the end of slot 142 which is closer to plate 96. This corresponds to the completely retracted position of the ram 84. At this time the crank pin 108 is closest to frame plate 96.

Assuming that the crank 106 moves in a counterclockwise direction, as viewed in FIG. 4, at the end of the first 90° of movement thereof, pin 108 will have moved to the right-hand end of slot 110 and legs 112 and 116 will have moved to the broken line position shown in FIG. 4, in which pin 126 is disposed at the end of slot 128 which is relatively remote from the ram 94. The assembly of the plates 118, 130 and 132, will not have moved relative to the plate 96.

In the course of the next 90° of movement of the crank 106, the parts will have moved to the relative positions illustrated in FIG. 5. As can be seen, the action of the crank pin 108 in the slot 110 moves legs 112 and 116 through the same distance and in the same direction as in the course of the first 90° of rotation of the crank 106. In the course of this second stage of movement of the ram 84, owing to the engagement of the lower end of slot 128 as viewed in FIGS. 4 and 5, with the pin 126, the assembly of the plates 118, 130 and 132 is moved through the same distance and in the same direction as the ram 84 with the pin 138 moving to the end of slot 142 relatively remote from the plate 96.

It will be seen that in the course of the first 180° of rotation of crank 106, ram 84 has moved through a distance equal to twice the length of one of the slots 128 or 142. Moreover, this movement is accomplished by a relatively compact mechanism. In addition, the drive mechanism shown does not require any parts disposed laterally outboard of the outer frame plates of the acceptor for providing a connection to the ram as was present in systems of the prior art utilizing the bill stacker shown in the '260 patent with an acceptor of the type shown in the '496 patent. Thus, the drive mechanism 86 permits of the use of a bill box 156 which can be unloaded from the sides thereof.

It will be seen that we have accomplished the objects of our invention. We have provided a compact bill acceptor which overcomes the defects of compact bill acceptors of the prior art. Our compact bill acceptor provides a relatively long ram stroke by use of a drive mechanism occupying a relatively small space. Our compact bill acceptor is especially adapted for use in installations where space is at a premium. It permits of the unloading of the bill box from either side thereof. Our improved compact bill acceptor is relatively simple in construction and operation for the results achieved thereby.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A bill acceptor for receiving and storing a plurality of bills deposited therein including in combination, a frame, a bill box having a front opening through which bills can be introduced into the box, means mounting said box on said frame for movement between an active position at which it can receive bills through said opening and an inactive position, a ram, means mounting said ram on said frame with said box in said active position for movement from a retracted condition at which a bill can be positioned between said ram and said opening and an advanced position at which it moves a positioned bill into said box, means on said frame forming a mouth into which bills can be inserted, means for moving a bill inserted into said mouth along a transport path to a position between said ram and said opening, drive means on said frame for moving said ram from said retracted position to said advanced position to move said bill in said position into said bill box, said ram mounting means comprising a slide, a first lost motion connection between said slide and said ram and a second lost motion connection between said slide and said frame.

2. A bill acceptor as in claim 1 in which said bill box has an opening in one side thereof through which a stack of bills can be removed, a side panel, and means mounting said side panel on said frame for movement in the active position of said box between a position at which said side opening is blocked and a position at which said side opening is clear.

3. A bill acceptor as in claim 2 in which said bill box has an opening in the other side thereof through which a stack of bills can be removed, a second side panel and means mounting said second side panel on said frame for movement in the active position of said box between a position at which said other side opening is blocked and a position at which the other side opening is clear.

4. A bill acceptor as in claim 3 in which said side panels are mounted for pivotal movement on said frame, said acceptor including a common spring for biasing said side panels to said positions at which their corresponding side openings are blocked.

5. A bill acceptor as in claim 1 in which each of said lost motion connections is a pin and slot connection extending in the direction of movement of said ram.

6. A bill acceptor as in claim 5 in which said driving means comprises a crank and a further pin and slot connection between said crank and said ram, said further pin and slot connection extending in a direction perpendicular to the direction of movement of said ram.

7. A bill acceptor for receiving and storing a plurality of bills deposited therein including in combination, a frame, a bill box having a front opening through which bills can be introduced into the box, means mounting said box on said frame for movement between an active position at which it can receive bills through said opening and an inactive position, a ram, means mounting said ram on said frame with said box in said active position for movement from a retracted condition at which a bill can be positioned between said ram and said opening and an advanced position at which it moves a positioned bill into said box, means on said frame forming a mouth into which bills can be inserted, means for moving a bill inserted into said mouth along a transport path to a position between said ram and said opening, and drive means on said frame for moving said ram from said retracted position to said advanced position to move said bill in said position into said bill box, said driving means moving said ram between said positions with a stroke of a predetermined length, said ram mounting means including an intermediate member, a first pin and slot connection between said ram and said intermediate member and a second pin and slot connection between said intermediate member and said frame, each of said slots extending in the direction of movement of said ram, said first connection permitting lost motion between said intermediate member and one of said ram and said frame during the initial portion of said ram stroke, said second connection permitting lost motion between said intermediate member and the other of said ram and said frame during the terminal portion of said stroke.

8. A bill acceptor as in claim 7 in which the lost motion provided by each of said pin and slot connections is approximately half said ram stroke.

9. A bill acceptor as in claim 8 in which said driving means comprises a crank.

10. A bill acceptor for receiving and storing a plurality of bills deposited therein including in combination, a frame, means on said frame forming a mouth into which bills can be inserted, means for moving a bill inserted into said mouth along a transport path to a bill accepted position, a bill box having an opening through which bills can be introduced into the box, means mounting said box on said frame with said opening at said bill accepted position, a ram, means mounting said ram on said frame for movement from a retracted position behind said bill accepted position to an extended position at which it moves a bill into said box, said mounting means comprising spaced first and second legs extending outwardly from said frame toward the back of said ram, spaced third and fourth legs extending from the back of said ram toward said frame, a first outer plate, a second outer plate, an intermediate plate, means for assembling said plates for movement as a unit, a first pin and slot connection between said second leg and said first outer plate, and a second pin and slot connection between said fourth leg and said second outer plate, each of said slots extending in the direction of movement of said ram, a crank, means mounting said crank for rotary movement on said first leg, a pin on said crank, a slot in said third leg for receiving said pin, said third leg slot extending transversely of the direction of movement of said ram, and means for rotating said crank to drive said ram.

11. A bill acceptor as in claim 10 in which the length of the slot in each of said pin and slot connections is approximately equal to the effective length of said crank.

* * * * *